US006080457A

United States Patent [19]

Charlton et al.

[11] Patent Number: 6,080,457

[45] Date of Patent: Jun. 27, 2000

[54] PARTICULATE SORBENT SMOKE FILTER

[75] Inventors: John Charlton, Washington; Paul Francis Clarke, South Shields; Ernest Brian Hayes, Leighton Buzzard, all of United Kingdom

[73] Assignee: Cigarette Components Limited, United Kingdom

[21] Appl. No.: 07/890,394

[22] Filed: May 26, 1992

Related U.S. Application Data

[63] Continuation of application No. 07/584,293, Sep. 18, 1990, abandoned.

[30] Foreign Application Priority Data

Sep. 26, 1989 [GB] United Kingdom ..... 8921659

[51] Int. Cl.[7] ..... A24D 3/00; A24D 3/16

[52] U.S. Cl. ..... 428/36.3; 428/36.9; 428/36.91; 131/203; 131/204; 131/207; 131/332; 131/342

[58] Field of Search ..... 131/203, 204, 131/207, 332, 334, 342; 428/36.3, 36.9, 36.91

[56] References Cited

U.S. PATENT DOCUMENTS

| | | | |
|---|---|---|---|
| 3,173,427 | 3/1965 | Tamblyn et al. | 131/342 |
| 3,319,630 | 5/1967 | Orrmins | 131/342 |
| 3,381,070 | 4/1968 | Sublett et al. | 131/342 |
| 3,407,822 | 10/1968 | Touey et al. | 131/342 |

*Primary Examiner*—Rena L. Dye
*Attorney, Agent, or Firm*—Frank J. Uxa

[57] ABSTRACT

A smoke filter consists of substrate threads and/or strips each pre-coated with particulate sorbent (e.g. activated carbon granules), gathered together in solid or tubular rod form e.g. within a containing sleeve. When the gathered threads and/or strips form a tubular body, this may be provided with a core.

8 Claims, No Drawings

PARTICULATE SORBENT SMOKE FILTER

This application is a continuation of application Ser. No. 07/584,293 filed Sep. 18, 1990, abandoned, and entitled PARTICULATE SORBENT SMOKE FILTER.

The present invention concerns filters (suitable but not necessarily for tobacco smoke filters) containing particulate sorbent—e.g. selected from activated carbon, silica gel, sepiolite, alumina, ion exchange material etc.

The various prior procedures for manufacturing such filters have suffered from one or more of production problems, problems of control over product quality and uniformity, and problems of machinery wear.

According to the invention a filter rod consists essentially of substrate threads and/or strips individually pre-coated with particulate sorbent adhering thereto and gathered together and held in rod form e.g. by a containing sleeve such as an extruded sleeve or a plugwrap with a lapped and stuck seam. The threads and/or strips in the product filter usually extend generally longitudinally of the rod.

The particulate sorbent is suitably adhered to said thread (s) and/or strip(s) by hot melt adhesive, high m.p. polyethylene glycol, or emulsion-type adhesive such as PVA. Suitable hot-melt adhesives for use in the invention are various polyester adhesives. Any particulate sorbent used may be a single substance or a mixture, and may be in admixture with other material.

The rod of sorbent-carrying threads and/or strips according to the invention may be tubular, in which case it may have a core. Such a core could be of conventional smoke filtering material (e.g. of filamentary tow, staple fibre, or creped paper); an open ended tube; or an impermeable or low-permeability portion which contributes to the composite filter pressure drop but has little or no filtering effect.

A containing sleeve for filters according to the invention nay be of smoke-permeable or -impermeable material, and in either case may be perforated. If the particulate coatings on the threads or strips are themselves coated with adhesive (e.g. heat-activatable adhesive) then bonding can be effected or initiated as the coated threads or strips are gathered together, to give a bonded rod which is dimensionally stable without a containing sleeve; the adhesive coating would need to be discontinuous (e.g. a powder coating) so as not to interfere unduly with the sorbent properties of the particulate sorbent. However, even if the pre-coated threads or strips are bonded, it is generally preferred to provide a containing sleeve for the rod.

The preformed particulate sorbent-coated threads are conveniently gathered and enwrapped to rod form using a conventional garniture. In the method according to the invention the supply of the particulate sorbent-carrying threads and/or strips, their gathering and formation into a solid or tubular rod (usually with application of a surrounding sleeve), and cutting of the resulting elongate product into finite lengths, can be conducted continuously and in-line using conventional filter manufacturing machinery. Where the rod is to be tubular, the threads and/or strips may be gathered around a central mandrel; where the tubular rod is to have a core, the core may be advanced continuously (e.g. from a hollow such mandrel) as the particulate sorbent-carrying threads and/or strips are gathered around it and enwrapped; continuous in-line procedures and apparatus for this are known in the cigarette filter art.

The thread(s) and/or strip(s) may be coated with adhesive (e.g. by drawing simultaneously through a bath or other supply of the active adhesive) and then with particulate sorbent (e.g. by drawing simultaneously through a reservoir, fluidised bed, circulated stream or other supply of the sorbent whilst the adhesive is active) as part of the above in-line continuous process; instead adhesive-coated thread (s) and/or strip(s) may be separately produced or obtained from an outside supplier, with activation (e.g. heat-softening) of the adhesive and application of particulate sorbent being conducted in-line and continuously with filter production. Uniform application of adhesive (e.g. from a bath of PVA liquid) may be ensured by doctoring, e.g. through an orifice or past or between a blade or blades. The loading of particulate sorbent onto the adhesive coated thread or strip will usually be the maximum possible, this depending on factors such as particle size, thread or strip perimeter, etc.

Additive-coated threads are preferred to strips for the purposes of the invention; one may employ as many of the additive-coated threads as desired, e.g. 20 or more per rod; but for most present purposes we incorporate up to 15 threads, e.g. 5 to 10 or 12, in the filter body. The additive loading per thread may vary widely (e.g. from 0.25 to 2.0 mg/mm), as may the total element loading (e.g. from 25 to 200 mg. for a 20 mm. length tip), according to product requirements.

Filter loading can of course be controlled by selecting the number of threads and/or their loading. Heavy loading of the threads and/or strips can give elements which consist substantially wholly of particulate sorbent, without disadvantages of the prior types of particulate filter component and their production methods. Elements according to the invention may incorporate a small amount of other material (e.g. other fibre or filament or particles or additive) but preferably consist substantially wholly of particulate sorbent adhered to the threads and/or strips (apart, of course, from the outer wrapper and from the core when present).

Other parameters may also vary widely according to product requirements, these including for example wt/length when thread is used to carry the particulate sorbent, the particle size of the sorbent, etc. A suitable additive-carrying thread is for example of about 1000 or 500 dtex; one suitable particle size for activated carbon is 12/30 British Standard Mesh, and another is 30/70 British Standard Mesh.

The thread or strip employed according to the invention may be of any innoxious material. The thread or strip may be a textile material, e.g. one or more monofilaments, a yarn or sliver or twine, or a woven or non-woven ribbon. A suitable thread is sewing thread, notable for its uniformity. The identity of the thread is not critical, and it may be of natural and/or synthetic fibres. Rayon, nylon and polyester are materials which can be used satisfactorily for the thread, but another material is cotton, especially mercerised cotton as employed for good quality sewing thread.

At least some of the particulate sorbent used may carry flavourant—or other material carrying flavourant may be incorporated.

The invention permits incorporation of activated carbon or other particulate sorbent in tobacco smoke filters using conventional apparatus without introducing production or apparatus problems and in particular with ready achievement of uniform sorbent loading—and simple and accurate variation of this loading when required. Filters according to the invention allow the particulate sorbent adhered to the thread(s) and/or strip(s) to exercise, unhindered or substantially so, its filtering effect on the tobacco smoke stream; thus filters according to the invention can give good retention of vapour phase smoke components.

Filters according to the invention can be produced continuously and cut into finite lengths. Each individual such finite length could be used on its own as a filter for a cigarette (e.g. for slim cigarettes, which are typically of about 18 mm. circumference), but is preferably employed in longitudinal alignment with at least one other filter element as part of a composite (e.g. dual or triple) cigarette filter; preferably an individual filter according to the invention is employed in conjunction with a longitudinally aligned buccal end element of conventional appearance—e.g. a uniform plug of cellulose acetate filamentary tow.

The invention is illustrated by the following working Examples. Examples 1 to 4 used polyester or nylon threads of about 550 dtex, pre-coated with adhesive. The particulate sorbent employed was activated carbon granules of particle size 12/22 British Standard mesh. In each Example the indicated number of threads was drawn simultaneously through a bath of PVA type liquid adhesive, with doctoring to give uniform application, and then through a circulating stream of the activated carbon to achieve the indicated carbon loading. The carbon-bearing threads then passed to a conventional wrapping garniture in which they were gathered and enwrapped in Ecusta Heat Seal perforated plugwrap to continuously form a rod which was cut to finite lengths as it emerged. Details of Examples 1 to 4 are summerised in Table 1. The pressure drops were measured enclosed—i.e. with only the end faces of the element exposed to air flow—under standard air flow conditions and are expressed in mm water gauge (Wg).

The vapour phase retention performance of filter elements as in Examples 3 and 4, but of 15 mm. rather than 60 mm. length, was tested. The 15 mm. filters were attached to commercial slim cigarettes and smoked on a standard smoking machine under standard conditions, and the delivery of various vapour phase components was measured chromatographically; although the filter plugwrap is perforate, lateral ventilation of the filter was prevented, to give "enclosed" delivery values. By comparison with a control, the percentage enclosed retention values set out in Table 2 were obtained.

TABLE 1

| EXAMPLE | THREAD TYPE | NUMBER OF THREADS | DRY CARBON LOADING PER THREAD mg/mm | DRY CARBON LOADING OF ELEMENT mg/mm | DRY CARBON LOADING OF ELEMENT total, g | ROD LENGTH mm | ROD CIRCUMFERENCE mm | ROD PRESSURE DROP mm |
|---|---|---|---|---|---|---|---|---|
| 1 | Polyester | 5 | 1.38 | 6.9 | 0.414 | 60 | 17.89 | 90 |
| 2 | Polyester | 7 | 0.88 | 6.16 | 0.37 | 60 | 17.84 | 33.3 |
| 3 | Polyester | 9 | 0.68 | 6.12 | 0.37 | 60 | 17.97 | 30.8 |
| 4 | Nylon | 9 | 0.99 | 8.9 | 0.535 | 60 | 18.92 | 68 |

EXAMPLE 5

Rods 90 mm. long and of 24.13 mm. circumference were made as described for Examples 1–4 above using 12 polyester (Trevira 550 dtex) threads, PVA type liquid adhesive (Borden Plastiflex A401), activated carbon granules (Chemviron SC2) of particle size 12/30 British Standard mesh, and a double wrap of Ecusta porous plugwrap. The carbon loading of the rods was 13.6 mg/mm, and the pressure drop of a 90 mm. rod was 38 mm.Wg.

EXAMPLE 6

To form triple filters, the 90 mm. rods of Example 5 were cut into 15 mm. lengths and fed end-to-end in abutting alternation with 12 mm.long unwrapped rods of bonded filamentary cellulose acetate tow (filament denier 5, tow denier $30\times10^3$), to a conventional wrapping garniture in which they were enwrapped in Ecusta porous plugwrap to form a composite rod; the composite rod was cut mid-way through each 12 mm. cellulose acetate portion to give triple filters, each having a 15 mm. length of Example 5 rod held in longitudinal abutment between 6 mm. long cellulose acetate end plugs by the outer Ecusta plugwrap. These triple filters were 27 mm. long and 24.42 mm. in circumference, with a carbon loading of 204 mg/filter. The triple filters had a pressure drop of 28 mm.Wg, and gave 40.5% tar retention and 25.6% nicotine retention, the vapour phase retentions were as shown in Table 2.

In Examples 5 and 6 each plugwrap used is porous, but this is not essential; such plugwrap could equally be chosen from porous, impermeable and perforate types. In Examples 5 and 6, the pressure drops and retentions are measured "enclosed" as for Examples 1–4.

TABLE 2

VAPOUR PHASE PERFORMANCE

| COMPOUND | EXAMPLE NUMBER 3 | 4 | 6 |
|---|---|---|---|
| METHANOL | 30.3 | 23.4 | 68.6 |
| ACETAL | 28.4 | 52.2 | 68.6 |
| ACETONITRILE | 36.4 | 61.2 | 79.9 |
| ACROLEIN | 46.7 | 55.9 | 79.0 |
| ACETONE | 49.0 | 71.8 | 80.2 |
| METHYLACETATE | 24.2 | 48.1 | 70.5 |
| ISOPRENE | 39.4 | 61.5 | 78.7 |
| BUTADIONE | 54.8 | 72.6 | 81.2 |
| BUTANONE | 60.8 | 80.1 | 84.6 |
| BENZENE | 47.6 | 78.4 | 76.7 |
| TOLUENE | 58.6 | 78.2 | 72.0 |

Products according to the invention are generally suitable for use as or in tobacco smoke filters, but whilst the invention has been described mainly in terms of such filters, it is not limited to this usage; it provides the defined products per se whatever their application or intended use.

What is claimed is:

1. A filter element consisting essentially of up to 20 longitudinally aligned substrate threads, and particulate sorbent in an amount in the range of 0.25 to 2.0 milligrams per millimeter of each substrate thread, each said substrate thread being substantially uniformly individually pre-coated with said particulate sorbent adhering thereto and gathered together and held in rod form.

2. A filter element according to claim 1 wherein the number of substrate threads consists of up to 15 substrate threads.

3. A filter element consisting essentially of up to 20 longitudinally aligned substrate threads, and particulate sorbent in an amount in the range of 0.25 to 2.0 milligrams per millimeter of each substrate thread, each said substrate thread being substantially uniformly individually pre-coated with said particulate sorbent adhering thereto and gathered together and held in tube form.

4. A filter element according to claim 3 wherein the number of substrate threads consists of up to 15 substrate threads.

5. A filter element comprising particulate sorbent and up to 15 longitudinally aligned substrate threads, said particulate sorbent being present in an amount in the range of 0.25 to 2 milligrams per millimeter of each substrate thread, said substrate threads being substantially uniformly individually pre-coated with said particulate sorbent adhering thereto and gathered together and held in rod form or in tube form.

6. A filter element according to claim 5 which is a tube component in a composite filter product in the form of a tube around a core.

7. The filter element according to claim 5 having up to 10 substrate threads.

8. The filter element according to claim 5 wherein said particulate sorbent comprises activated carbon granules.

* * * * *